US007526989B2

(12) United States Patent
Paul et al.

(10) Patent No.: US 7,526,989 B2
(45) Date of Patent: May 5, 2009

(54) GUN TUBE SUPPORT ASSEMBLY

(75) Inventors: Lothar Alwin Paul, Pretoria (ZA); Theunis Gerhardus Nicolaas Kotze, Pretoria (ZA); Rolf Reitz De Swardt, Pretoria (ZA)

(73) Assignee: Denel (Pty) Ltd, Pretoria (ZA)

( * ) Notice: Subject to any disclaimer, the term of this patent is extended or adjusted under 35 U.S.C. 154(b) by 475 days.

(21) Appl. No.: 10/538,479

(22) PCT Filed: Dec. 8, 2003

(86) PCT No.: PCT/ZA03/00182

§ 371 (c)(1),
(2), (4) Date: Jun. 7, 2005

(87) PCT Pub. No.: WO2004/053418

PCT Pub. Date: Jun. 24, 2004

(65) Prior Publication Data

US 2006/0112818 A1 Jun. 1, 2006

(30) Foreign Application Priority Data

Dec. 12, 2002 (ZA) ..... 02/10079

(51) Int. Cl.
*F41A 21/00* (2006.01)

(52) U.S. Cl. ..... 89/14.3; 89/37.01

(58) Field of Classification Search ..... 89/14.3, 89/37.04, 37.12, 37.13, 37.22, 44.01, 37.01; 42/124, 75.02, 75.04, 94
See application file for complete search history.

(56) References Cited

U.S. PATENT DOCUMENTS 3,606,218 A * 9/1971 Enlund et al. ..... 248/74.2
4,125,052 A * 11/1978 Thomas ..... 89/34
4,168,049 A 9/1979 Peritt
4,483,235 A 11/1984 Hallqvist
4,638,714 A 1/1987 Heintz et al.
5,703,318 A * 12/1997 Franchino et al. ..... 89/37.07

FOREIGN PATENT DOCUMENTS

GB 559586 2/1944
GB 1099651 1/1968
GB 2 157 406 A 10/1985

OTHER PUBLICATIONS

International Search Report of PCT/ZA03/00182 mailed Apr. 16, 2004.

* cited by examiner

*Primary Examiner*—J. Woodrow Eldred
*Assistant Examiner*—Gabriel J Klein
(74) *Attorney, Agent, or Firm*—Nixon & Vanderhye P.C.

(57) ABSTRACT

This invention relates to a gun tube support assembly (10), which comprises four support sections (12) arranged annularly around a gun tube (13) and received in an opening in a cradle (15) of a gun. Each support section (12) comprises a bush housing (14), a cradle bush (16) and a damping means sandwiched between the bush housing (14) and cradle bush (16). The damping means is in the form of a rubber pad (18) made of relatively high-temperature silicon rubber. The rubber pad (18) includes a plurality of protrusions 18.1 extending from a face of the pad (18) for abutting an outer surface of the cradle bush (16). The protrusions (18.1) accommodate compression of the pad (18), the arrangement being such that the rubber pad (18) absorbs and dampens kinetic energy emanating from the gun tube (13) during firing of a projectile.

14 Claims, 3 Drawing Sheets

GUN TUBE SUPPORT ASSEMBLY

This application is the U.S. national phase of international application PCT/ZA2003/000182, filed 8 Dec. 2003, which designated the U.S. and claims priority of ZA 02/10079, filed 12 Dec. 2002, the entire contents of each of which are hereby incorporated by reference.

INTRODUCTION AND BACKGROUND TO THE INVENTION

This invention relates to a gun tube support assembly, a cradle for carrying a gun tube including a gun tube support assembly, and a gun provided with a gun tube support assembly.

A conventional gun tube support assembly for a gun such as a cannon or the like comprises a single solid metal cradle bush or a plurality of solid metal cradle bushes arranged annularly around a gun tube of the gun. The annularly arranged cradle bushes receive and support the gun tube and the gun tube slides therein when the gun is fired.

A first disadvantage of the conventional gun tube support assembly is that when the gun is fired, kinetic energy is transferred from a projectile passing through the gun tube to the cannon structure via the solid cradle bushes to cause metal fatigue and a decrease in the lifespan of the gun.

Further disadvantages of the conventional gun tube support assembly are that the solid metal cradle bushes retains expansion and vibration of the gun tube and thus restrains the projectile when passing through the gun tube and causes excessive structural strains in the projectile, thus having a negative effect on internal and external ballistics. The projectile is further less reliable owing to the vibrations restraining it while passing through the gun tube.

OBJECT OF THE INVENTION

It is therefore an object of the present invention to provide a gun tube support assembly, a cradle for carrying a gun tube including a gun tube support assembly, and a gun provided with a gun tube support assembly with which the aforesaid disadvantages can be overcome or at least minimised.

SUMMARY OF THE INVENTION

According to a first aspect of the invention there is provided a gun tube support assembly comprising a plurality of support sections arranged annularly around a gun tube, each including:

- a bush housing;
- a cradle bush for the bush housing for receiving and supporting the gun tube; and
- a damping means sandwiched between the bush housing and cradle bush, for absorbing and damping kinetic energy emanating from the gun tube during firing thereof.

The damping means may be a resilient body selected from the group consisting of a rubber pad, a spring, and a pneumatic or hydraulic cushion.

Preferably the damping means comprises a pad of a relatively high-temperature silicon rubber.

The rubber pad may include a plurality of protrusions extending from a face of the pad for accommodating compression of the pad.

Each bush housing may comprise a curved bush housing plate having an inner surface for abutting the resilient body.

End flanges for connecting the bush housing to a cradle of a gun may be disposed towards opposite ends of the bush housing plate.

Removable side flanges for retaining the rubber pad may further be connectable to the sides of the plate.

Each cradle bush may comprise a cradle bush plate curved complementary to the bush housing plate and having an inner surface for abutting the gun tube and an outer surface for abutting the resilient body.

End flanges may extend in the direction of the bush housing from the respective opposite ends of the cradle bush plate.

The protrusions extending from the rubber pad may face towards the gun tube to abut the outer surface of the cradle bush plate.

Preferably, the gun tube support assembly includes from two to six, preferably four support sections arranged annularly around the gun tube and received in an opening in the cradle.

The cradle bush may be biased in the direction of the gun tube to keep the cradle bush in contact with the gun tube and to allow for thermal expansion of the gun tube.

According to a second aspect of the invention there is provided a cradle for carrying a gun tube including a gun tube support assembly according to the first aspect of the invention.

According to a third aspect of the invention there is provided a gun provided with a gun tube support assembly according to the first aspect of the invention.

BRIEF DESCRIPTION OF THE DRAWINGS

The invention will now be described further by way of a non-limiting example with reference to the accompanying drawings wherein.

DESCRIPTION OF A PREFERRED EMBODIMENT OF THE INVENTION

Figure 1:
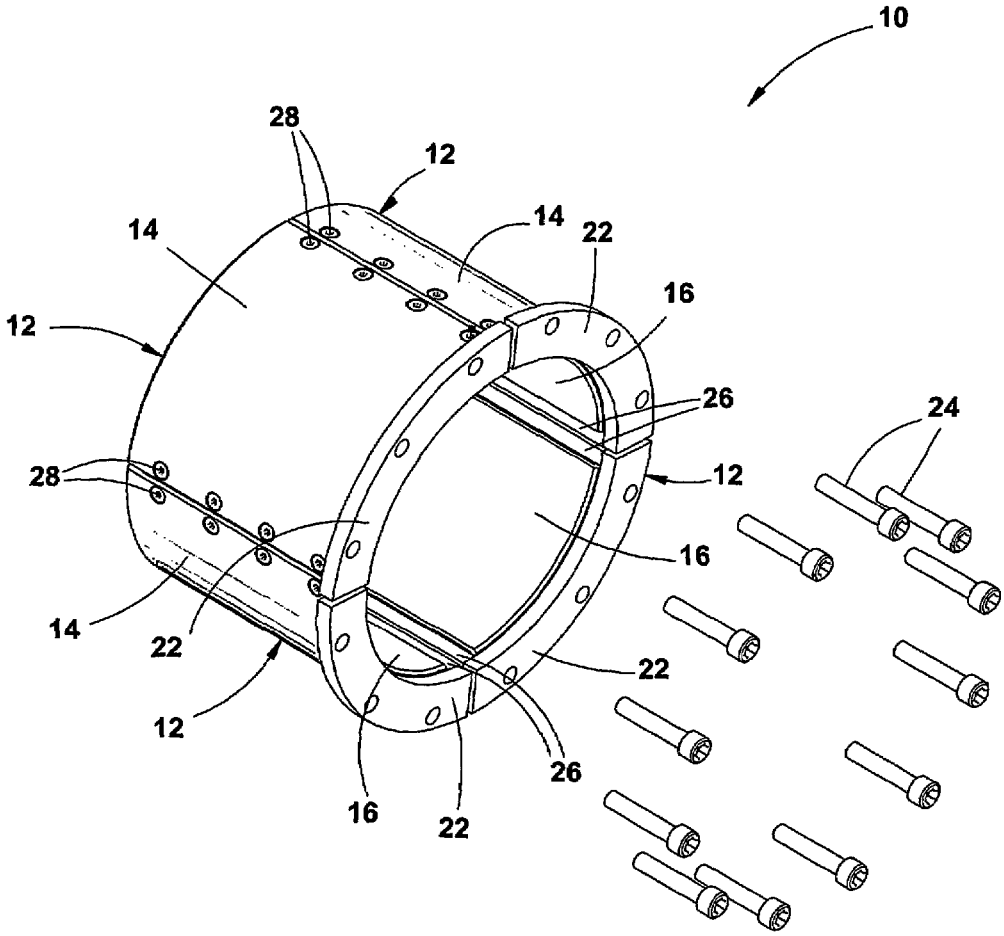
FIG. 1 is a perspective view of an assembled gun tube support assembly according to a preferred embodiment of the invention.
Figure 2:
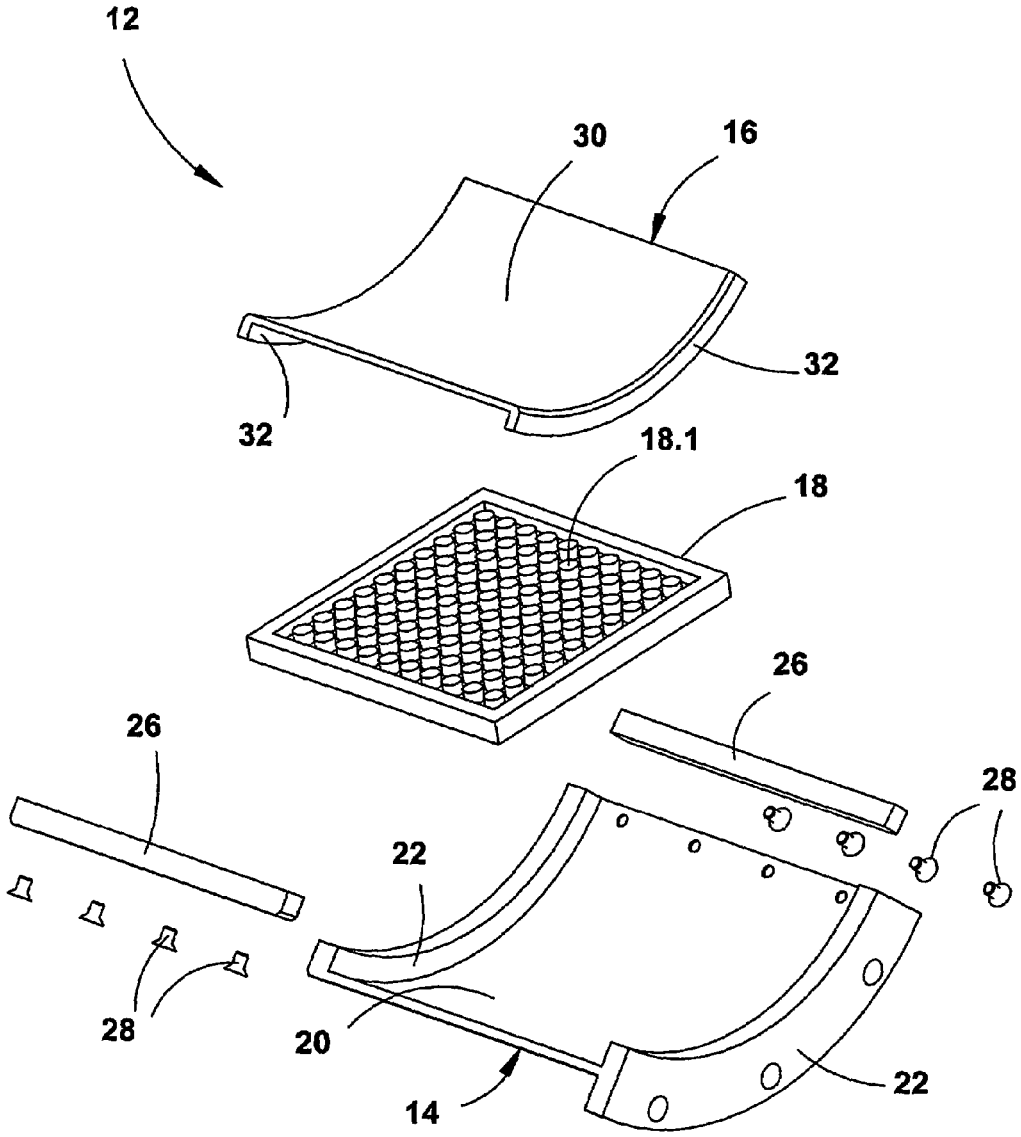
FIG. 2 is a perspective exploded view of a support section of the gun tube support assembly of FIG. 1.

Referring to 1, a gun tube support assembly according to a preferred embodiment of the invention is generally designated by reference numeral 10.

Figure 3:
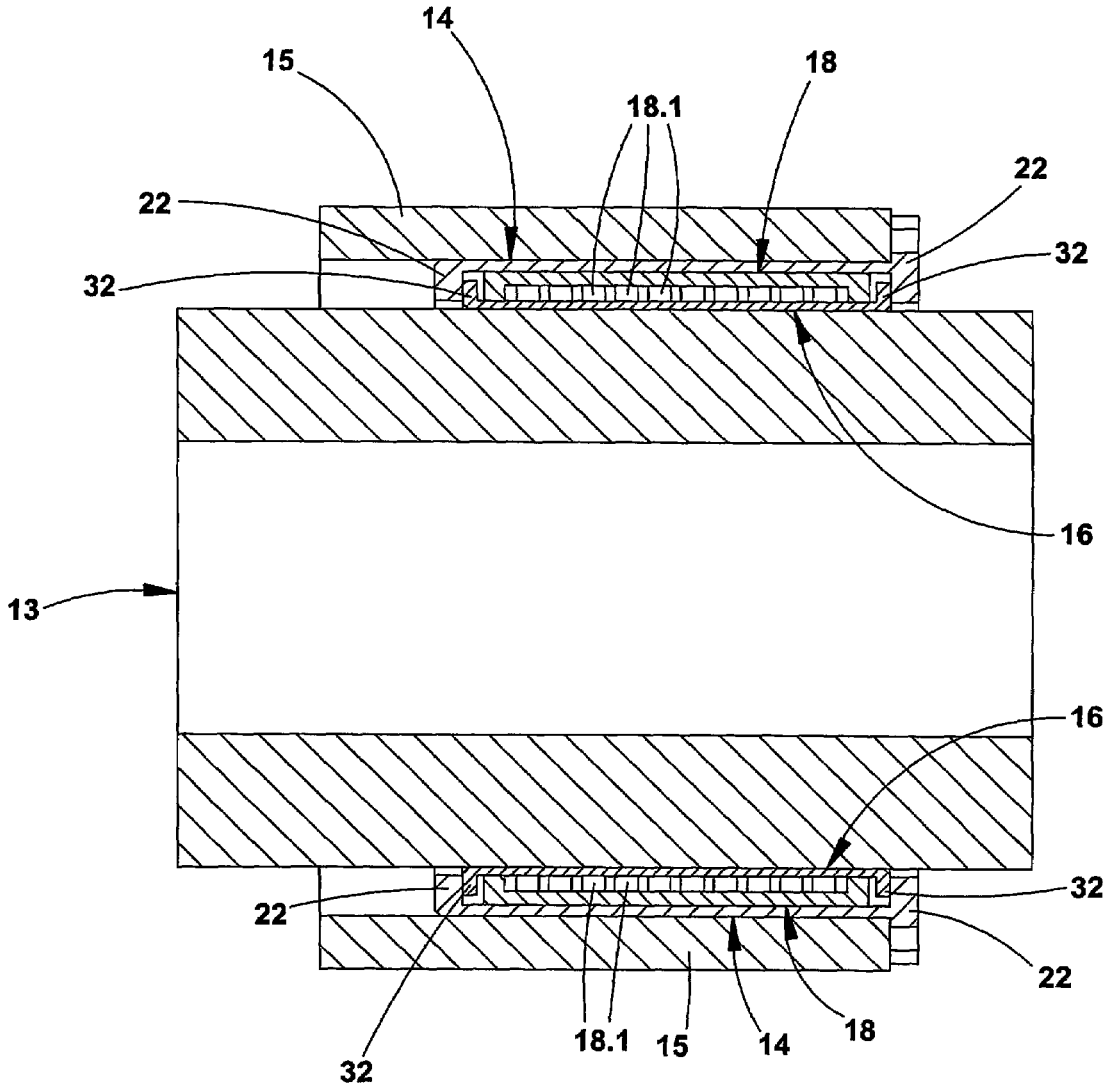
FIG. 3 is a longitudinal-sectional view of the gun tube support assembly of FIG. 1 surrounding a gun tube.

The gun tube support assembly 10 comprises four support sections 12 arranged annularly around a gun tube 13 (shown in FIG. 3) and received in an opening in a cradle 15 of a gun (not shown), such as a cannon. The support assembly 10 therefore supports the gun tube 13 while allowing movement of the gun tube 13 relative to the cradle 15 when the gun is fired.

Each support section 12 comprises a bush housing 14 and a cradle bush 16 for the bush housing 14, which receives and supports the gun tube 13. Each support section 12 further comprises a damping means sandwiched between the bush housing 14 and cradle bush 16.

The damping means is in the form of a resilient body, such as a rubber pad 18 made of relatively high-temperature silicon rubber. The rubber pad 18 includes a plurality of protrusions 18.1 extending from a face of the pad 18 for abutting an outer surface of the cradle bush 16. The protrusions 18.1 accommodate compression of the pad 18, the arrangement being such that the rubber pad 18 absorbs and dampens kinetic energy emanating from the gun tube 13 during firing of a projectile (not shown).

Each bush housing 14 comprises a curved bush housing plate 20 having an inner surface for abutting the rubber pad 18. End flanges 22 for connecting the bush housing 14 to the cradle 15 of the gun, by fastening means 24, are disposed towards opposite ends of the bush housing plate 20. Removable side flanges 26 for retaining the rubber pad 18 is further connected to the sides of the bush housing plate 20, by fastening means 28.

Each cradle bush 16 comprises a cradle bush plate 30 curved complementary to the bush housing plate 20 and has an inner surface that abuts the gun tube 13 and an outer surface that abuts the rubber pad 18. End flanges 32 extend in the direction of the bush housing 14 from the respective opposite ends of the cradle bush plate 30. The cradle bush 16 is made of brass to provide a smooth surface on which the gun tube 13 is supported and on which it slides, thus minimising friction.

In use, when the gun is fired and a projectile passes through the gun tube 13, the latter slides in the annular support assembly 10. Expansion of the gun tube owing to internal gas pressure behind the projectile as it passes through the gun tube support assembly 10, is absorbed and dampened by the rubber pad 18.

It will be appreciated that the rubber pad 18 absorbs and dampens kinetic energy such as vibrations, and restricts it from being transferred from the passing projectile through to the cannon structure when the gun is fired. The cradle bush is biased in the direction of the gun tube to keep the cradle bush in contact with the gun tube and to allow for thermal expansion of the gun tube. Metal fatigue is therefore limited and internal and external ballistics not as greatly affected. The applicant further foresees that less transversal forces will act on the projectile, thus increasing its performance. It will further be appreciated that gun-jump and firing moment will be reduced through use of the gun tube support assembly 10.

It will also be appreciated that variations in detail are possible with a gun tube support assembly, a cradle for carrying a gun tube including a gun tube support assembly, and a gun provided with a gun tube support assembly according to the invention without departing from the scope of the appended claims.

The invention claimed is:

1. A gun tube support assembly in which the gun tube slides when a projectile is fired through the gun tube, the gun tube support assembly comprising: a plurality of separable support sections that when connected are arranged annularly around the gun tube, each support section including: a bush housing; a cradle bush for the bush housing for receiving and supporting the gun tube and on which the gun tube slides within the gun tube support assembly when the projectile is fired through the gun tube; and a damping means sandwiched between the bush housing and cradle bush, for absorbing and damping kinetic energy emanating from the gun tube during the firing of the projectile through the gun tube.

2. A gun tube support assembly according to claim 1 wherein the damping means is a resilient body selected from the group consisting of a rubber pad, a spring, and a pneumatic or hydraulic cushion.

3. A gun tube support assembly according to claim 2 wherein the damping means comprises a pad of a relatively high-temperature silicon rubber.

4. A gun tube support assembly according to claim 3 wherein the rubber pad includes a plurality of protrusions extending from a face of the pad for accommodating compression of the pad.

5. A gun tube support assembly according to claim 2 wherein each bush housing comprises a curved bush housing plate having an inner surface for abutting the resilient body.

6. A gun tube support assembly according to claim 5 wherein end flanges for connecting the bush housing to a cradle of a gun are disposed towards opposite ends of the bush housing plate.

7. A gun tube support assembly comprising:

a plurality of support sections arranged annularly around a gun tube, each including:

a bush housing;

a cradle bush for the bush housing for receiving and supporting the gun tube; and a damping means sandwiched between the bush housing and cradle bush, for absorbing and damping kinetic energy emanating from the gun tube during firing thereof, the damping means being a resilient body selected from the group consisting of a rubber pad, a spring, and a pneumatic or hydraulic cushion;

each bush housing comprising a curve bush housing plate having an inner surface for abutting the resilient body; and wherein end flanges for connecting the bush housing to a cradle of a gun disposed towards opposite ends of the bush housing plate; and wherein removable side flanges for retaining the resilient body are further connectable to the sides of the bush housing plate.

8. A gun tube support assembly according to claim 7 wherein each cradle bush comprises a cradle bush plate curved complementary to the bush housing plate and having an inner surface for abutting the gun tube and an outer surface for abutting the resilient body.

9. A gun tube support assembly according to claim 8 wherein the end flanges extend in the direction of the bush housing from the respective opposite ends of the cradle bush plate.

10. A gun tube support assembly according to claim 9 wherein the protrusions extending from the rubber pad face towards the gun tube to abut the outer surface of the cradle bush plate.

11. A gun tube support assembly according to claim 1 which includes from two to six support sections arranged annularly around the gun tube and received in an opening in a cradle of the gun.

12. A gun tube support assembly according to claim 1 wherein the cradle bush is biased in the direction of the gun tube to keep the cradle bush in contact with the gun tube and to allow for thermal expansion of the gun tube.

13. A cradle for carrying a gun tube including a gun tube support assembly according to claim 1.

14. A gun provided with a gun tube support assembly according to claim 1.

* * * * *